US005928058A

United States Patent [19]

Francis et al.

[11] Patent Number: 5,928,058

[45] **Date of Patent: *Jul. 27, 1999**

[54] SLOT CAR AND MECHANISM FOR GUIDING SAME

[76] Inventors: Geoffrey V. Francis, 521 Pipers Green, Oakville, Ontario, Canada, L6M-1H2; Stephen W. Pendry, 220 Spencer Avenue, Thronton, Ontario, Canada, L0L-2N0

[ * ] Notice: This patent issued on a continued prosecution application filed under 37 CFR 1.53(d), and is subject to the twenty year patent term provisions of 35 U.S.C. 154(a)(2).

[21] Appl. No.: 08/868,740

[22] Filed: Jun. 4, 1997

Related U.S. Application Data

[60] Provisional application No. 60/019,278, Jun. 7, 1996.

[51] Int. Cl.[6] ..... A63H 17/14; A63H 17/385

[52] U.S. Cl. ..... 446/446; 446/454; 446/457

[58] Field of Search ..... 446/433, 444, 446/446, 454, 455, 456, 457, 460, 465

[56] References Cited

U.S. PATENT DOCUMENTS

| | | | |
|---|---|---|---|
| 3,447,257 | 6/1969 | Ieda | 446/446 |
| 3,586,328 | 6/1971 | Kazel | 446/446 X |
| 4,187,637 | 2/1980 | Nielsen . | |
| 4,248,012 | 2/1981 | Kirby et al. | 446/460 |
| 4,795,154 | 1/1989 | Lahr | 446/446 X |
| 4,878,876 | 11/1989 | Ishimoto | 446/446 |
| 5,075,515 | 12/1991 | Yoneda et al. | 446/446 X |
| 5,218,909 | 6/1993 | Ng | 104/60 |

FOREIGN PATENT DOCUMENTS

| | | | |
|---|---|---|---|
| 1291644 | 5/1991 | Canada . | |
| 0057246 | 8/1982 | European Pat. Off. . | |
| 0280920 | 9/1988 | European Pat. Off. . | |
| 2809250 | 9/1978 | Germany | 446/455 |
| 2949046 | 6/1981 | Germany . | |

*Primary Examiner*—John A. Ricci
*Attorney, Agent, or Firm*—Thoburn T. Dunlap

[57] ABSTRACT

A self-propelled model vehicle adapted for use on a closed loop raceway having a guide slot coextensive therewith is provided with a guide arm including a downwardly depending guide pin that engages with the guide slot of the raceway. The guide slot defines the boundary between two adjacent lanes of the raceway. The guide arm is controlled by a motor for lateral movement. The lateral movement of the guide arm forces the guide pin against a side of the guide slot to effect the lateral displacement of the model vehicle into the adjacent lane of the raceway. Also provided is a raceway layout comprising a plurality of modular sections each section having an integral guide slot therein. In the assembled mode the guide slot defines a closed loop guide way for engaging a slot car.

20 Claims, 13 Drawing Sheets

SLOT CAR AND MECHANISM FOR GUIDING SAME

This application claims the benefit of priority from copending provisional application Ser. No. 60/019,278 filed on Jun. 7, 1996.

BACKGROUND OF THE INVENTION

1. Technical Field

The present invention generally relates to model racing cars for use in electric track games. More specifically, the invention relates to model slot cars that are maneuverable about a predetermined pathway around a closed loop track. The cars employ a remotely controlled steering mechanism including a guide arm that engages a slot in the track and effects the lateral displacement of the car, allowing a game player to change lanes and pass an opponent's car along the track.

2. Background

Slot car track games are well known in the art. The simplest embodiment of the game includes a closed loop track that simulates a street, highway or race track (hereinafter collectively referred to as raceway). The raceway generally comprises two or more coextensive lanes, each defined by a guide way or slot in the surface of the track which is adapted to receive a downwardly projecting pin that is immovably fixed to the underside of a model car for guiding the car around the track. The slots are arranged in generally parallel relationship to one another at a predetermined distance in order to alleviate lane interference when the model cars or vehicles are overtaking and passing one another. Busbars or power rails to which a direct current electrical source is coupled are provided on either side of each slot. The power rails engage with corresponding pick-up brushes or shoes on the model vehicle to provide electrical current to a drive motor mounted on the model. Each vehicle has a controller which controls the power supply to the motor. The greater the magnitude of the voltage supplied to the motor, the faster the model vehicle will move around the raceway. While these vehicles have the ability to overtake one another, the operator of the model is constrained to follow a fixed, predetermined path defined by the slot on the surface of the track. Because these models lack steering control, there is no interaction between the racing vehicles other than the ability for one vehicle to overtake another.

With the ever increasing sophistication of the racing game enthusiast, there is a growing demand for more realistic and interactive racetrack games. Since the play value of the foregoing prior art car and track system is limited to the regulation of the speed of travel, attempts have been made to provide track games which enable an operator to control movement of the vehicle from one lane to the other without the constraint of a guide slot in the track surface.

A racing game which has been suggested to avoid the constraints of the foregoing slot car systems is disclosed in U.S. Pat. No. 4,187,637. A slotless track with laterally spaced side walls defining two vehicle lanes therebetween is provided for use with steerable models that are devoid of guide pin means. These guide pinless cars are steered so as to be biased against one or the other of the side walls by selecting the polarity of the direct current voltage applied to the electric drive motor in each car. The voltage is applied through electrically conductive strips extending along the track in each lane. These model vehicles are steered by adapting the rear wheels to be individually rotatable on the rear axle, and by providing a somewhat complex gear train from the motor such that one or the other of the rear wheels is driven in the forward direction depending upon the direction of rotation of the motor which, in turn, depends upon the polarity of the DC voltage applied to the motor. While slotless track game vehicles have interactive advantages over conventional slot guided vehicles when attempting to overtake and pass an opponent on a straight section of track, the advantage is nullified when racing through curves which are a necessary part of a closed loop track circuit. Unfortunately, slotless track games have not yet been able to overcome the laws of physics (e.g., centrifugal force) in that the high rate of acceleration and velocity combined with the relative low mass of the model, frequently results in the vehicle leaving the track upon entering a curve. This effects down time or the necessity for the vehicle operator to slow the vehicle down upon entering a curve. In addition, since each lane has associated power rails, vehicle speed is unavoidably reduced when attempting a lane change because electrical current is not available between lanes.

Another drawback of the slotless track game system involves the burdensome and difficult task of the operator having to continually steer the vehicle. Steering a fast moving model around a raceway is difficult because the model rounds the track in a very short time relative to an actual automobile race. Very few persons possess the skills or endurance to continually steer the model vehicle about the raceway.

To address the problems posed by centrifugal force when entering curves at high velocities, power loss when effecting a lane change, and the burdensome task of having to continually steer the model vehicle around the track, U.S. Pat. No. 4,878,876 provides a self-powered vehicle that is adapted to run on a trackway having a plurality of lane defining guide slots. The vehicle includes on its underside a guide element having a downwardly biased guide pin that is engageable with the guide slots in the trackway. The guide element is provided with a remotely controlled magnetic coil for engaging and disengaging the guide pin with the guide slot. A steering control mechanism connected to the front steering wheels of the vehicle is adapted to work in concert with the guide element so that when the electromagnetic coil is energized the guide pin upwardly disengages from the guide slot and the steering control mechanism is simultaneously actuated, allowing the operator to steer the vehicle toward an adjacent guide slot. When the model is over the desired guide slot the magnetic coil is de-energized allowing the re-engagement of the downwardly biased guide pin with the new slot and the simultaneous straightening of the front steering wheels. The steering wheels are biased so as to return to the forward position upon de-energizing the magnetic coil.

Despite advances over prior art track games, the '876 track game has its shortcomings. Lane changes can only be effected on the straight sections of the raceway. High velocity lane changes on curves are impossible due to centrifugal forces acting to drive the vehicle off the track when the guide pin is disengaged therefrom. These drawbacks require opposing players to carry out their racing strategies on the straightaways, thus detracting from the realism and excitement of the game. Even on the straightaways the racing vehicle must be slowed down to effect a lane change, because "fishing" for an adjacent guide slot with the guide pin is difficult at high speeds. The absence of the capability to maneuver the vehicle on the curve at high rates of speed coupled with the necessity to slow down to effect a lane change on the straightaway, makes this game a less than acceptable simulation of a real automobile race.

U.S. Pat. No. 5,218,909 discloses a model vehicle racing apparatus comprising a track having first and second guide slots, a lane changing slot disposed between the first and second guide slots and a racing vehicle for use on the track. The racing vehicle is provided with a guide member for engagement with the guide slots wherein the degree of protrusion of the guide member into the guide slots is controlled so that the lane changing slot can be selectively engaged by the racing vehicle to effect a lane change. The guide member is always engaged in a slot alleviating the necessity to "fish" for a slot when effecting a lane change. However, the operator or player is constrained to follow a predetermined pathway since the lane changing slots are located at fixed locations about the track. The game players are not free to execute a passing maneuver until a lane changing slot is encountered.

In order to enhance the play value of electronic track games, it would be desirable to provide games that permit the individual operator to plan and execute racing strategies with as much realism as would be encountered under actual racing conditions. Model slot car racing would be more enjoyable if the operator could maneuver the vehicle, control its speed, and yet not be burdened with having to steer it at all times. Accordingly, there is a need for a model racing vehicle that permits the operator to simulate actual driving conditions and execute racing strategies utilizing the full gamit of the raceway.

SUMMARY OF THE INVENTION

Accordingly, it is a general object of the present invention to provide a model racing vehicle for use on a slotted raceway, said vehicle being selectively maneuverable by an operator about the course of said raceway.

It is another object of the invention to provide maneuvering means for a model racing vehicle that alleviates the necessity for a raceway with multiple guide slots.

A still further object of the invention is to provide a model racing vehicle which is adapted to move along a single guide slot and change from one lane to another.

Another object of the invention is to provide a model racing vehicle for use in a game in which separate vehicles share the same guide slot and can be independently controlled by game players to move from one lane to another to effect a passing maneuver.

A further object of the invention is to provide a model racing vehicle that is capable of maneuvering and effecting lane changes at high speeds on straight and curved track sections of a raceway.

Yet another object of the present invention is to provide a model racing vehicle that is self-powered and remotely controlled for controlling both the maneuvering means of the vehicle and the speed of the vehicle.

Yet another object of the invention is to provide a means for maneuvering a model vehicle without the necessity for steerable wheels.

It is a further object of the invention to provide an electronic raceway game comprising a slotted track and at least one maneuverable model racing vehicle.

It is yet another object of the invention to provide a model racing vehicle that is easily controlled, relatively simple in construction, economical to manufacture and durable in operation.

It is yet another object of the invention to provide a modular raceway layout that is easily assembled.

It is still another object of the invention to provide a game layout having a continuous guide slot that branches into a plurality of raceway course configurations.

A further object of the invention is the provision of a modular raceway layout that is easy to modify, relocate and store.

In accordance with one aspect of the present invention, a model vehicle for racing on a slotted raceway is provided, said vehicle includes a chassis, a body secured on the chassis, a pair of front and rear track engaging wheels, including a pair of drive wheels rotatably mounted to the chassis, a drive motor for driving the wheels, and a guide element means for maneuvering the model around a raceway. A drive transmission is mounted on the chassis connecting the output of the drive motor to the drive wheels. The vehicle guide means includes a guide arm having a track engaging end and a pivot end. The pivot end of the guide arm is pivotly mounted to the chassis, while the track engaging end of the guide arm projects forward of the pivot end toward the front end of the vehicle. The track engaging end of the guide arm includes a downwardly projecting pin that engages into a guide slot on the track for sliding contact therein. The guide arm is adapted to rotate about a vertical axis perpendicular to the longitudinal centerline of the vehicle and is driven by a motor means for lateral movement from one side of the model vehicle to the other. The controllable guide arm enables the operator to effectively steer the car from one side of the guide slot to the other and to maneuver the model through an optimum line around a curve.

In one embodiment of the invention, the model racing vehicle is self-powered and remotely controlled. Remote control means is provided for controlling both the guide means and the speed of the vehicle. In another embodiment, the model vehicle is powered through a direct current transformer that supplies electrical current to the model via conductive busbars that are parallel to and/or coextensive with the guide slot.

The invention also includes a raceway wherein the surface of the track has at least one guide slot. The raceway comprises an endless or closed loop track, the surface of which having a guide slot running longitudinally along or parallel to the approximate centerline thereof. The guide slot is coextensive with the track surface of the model raceway. Adjacent to each side of a guide slot is a lane of sufficient width to accommodate a model vehicle of the invention. The raceway with guide slot(s) can be configured to accommodate the side-by-side racing of two or more model vehicles.

These and other objects, features and advantages of this invention will become apparent in the detailed description set forth hereinbelow.

DETAILED DESCRIPTION OF THE INVENTION

In the figures like numbers and letters represent like elements in the respective views.

Figures 1, 2:
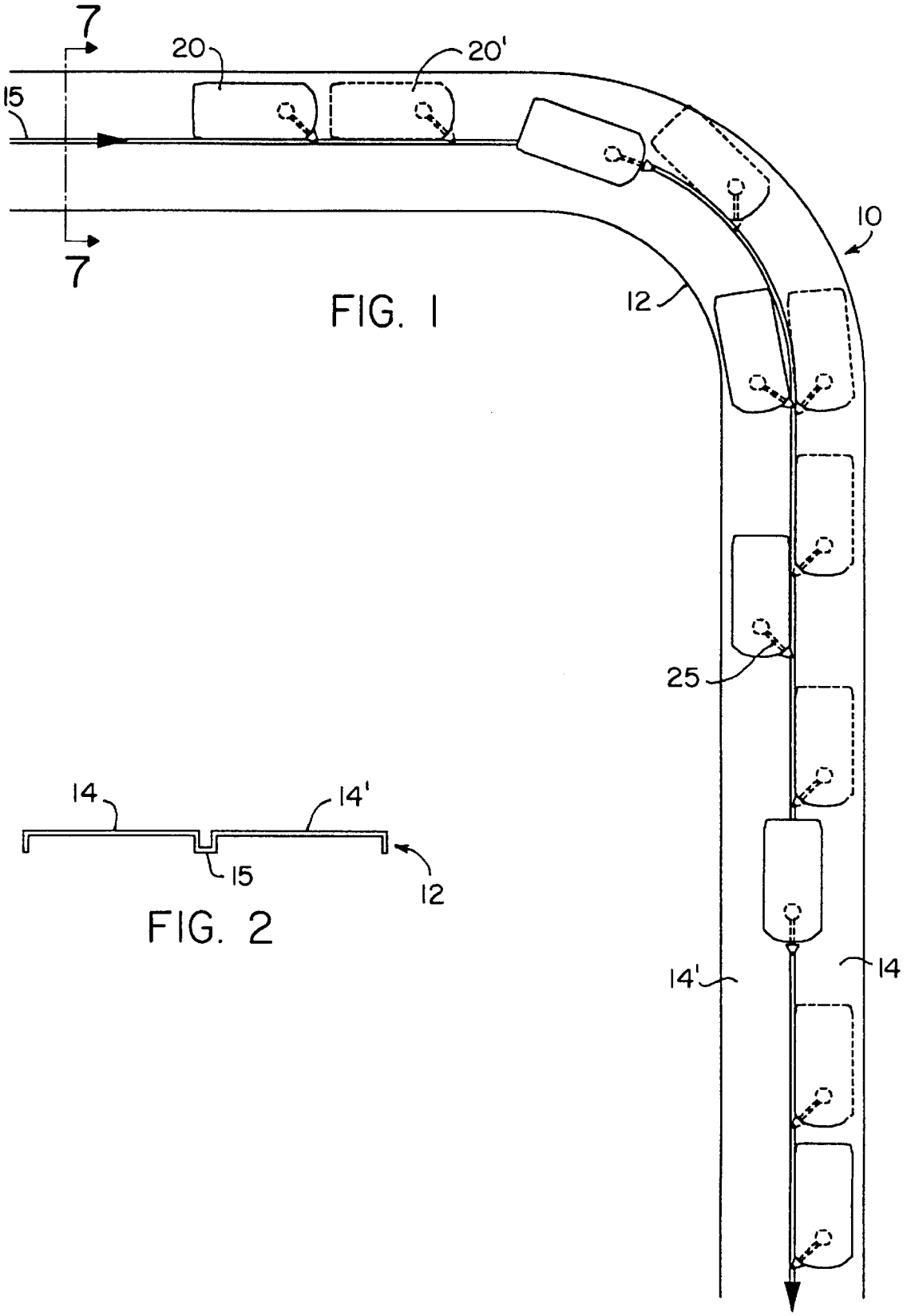
FIG. 1 is a schematic top view of a section of raceway illustrating the relative maneuverability of the racing vehicles of the present invention.
FIG. 2 is a cross sectional view of a track embodiment of the present invention taken through line 7—7 of FIG. 1.

In FIG. 1, a portion of a track game generally indicated at 10 is depicted. The cross section of track shown in FIG. 2 is taken through line 7—7 of FIG. 1. In an aspect of the invention shown in FIGS. 1 and 2, the track game includes a track 22 on which a model racing vehicle 20 and/or 20 is guided. In a fully assembled track game, track R2 forms a continuous simulated raceway on which the model vehicle (s) is operated. Track 22 is comprised of a plurality of interconnected track segments (not shown) that includes straight and curved sections. Each of the track segments include at least one guide slot running longitudinally on or parallel to the approximate centerline thereof. The track segments are connected together by known connecting means to form a closed loop. Upon assembling the track segments to form a desired closed loop configuration, the guide slot(s) continues through all segments defining a continuous guide way(s) that is coextensive with the raceway configuration. The coextensive guide way or guide slot runs longitudinally on or parallel to the approximate centerline of the raceway and is indicated at 15. The areas immediately adjacent to each side of the guide slot are referred to herein for purposes of definition as the track with the area on each side of the guide slot functioning as lanes generally indicated at 14 and 14'. For illustrative purposes, the direction of travel of racing vehicles 20 and 20 is indicated by the solid arrowheads superimposed on the guide slot as shown in the figure. Guide slot 1 is adapted to receive a guide pin (not shown) that is positioned on guide arm 25.

The guide arm 25 is pivotly connected at a pivot point (to be described hereinbelow) to the chassis of model racing vehicle 20, 20'. The guide arm is adapted to be controlled by an operator for side to side movement about its pivot point. The lateral movement of guide arm 25 effects a positional change of vehicle 20, 20' as schematically illustrated in the figure. The pivotal movement of the guide arm results in the lateral displacement of the vehicle across the track and into an adjacent lane. The forward movement of the vehicle coupled with the lateral displacement effected by the guide arm results in a highly controllable and maneuverable racing vehicle. Consequently, the need for steerable wheels to effect a lane change is alleviated, keeping operator fatigue to a minimum. In addition, the construction of the model is kept simple allowing for economical manufacture.

Figure 3:
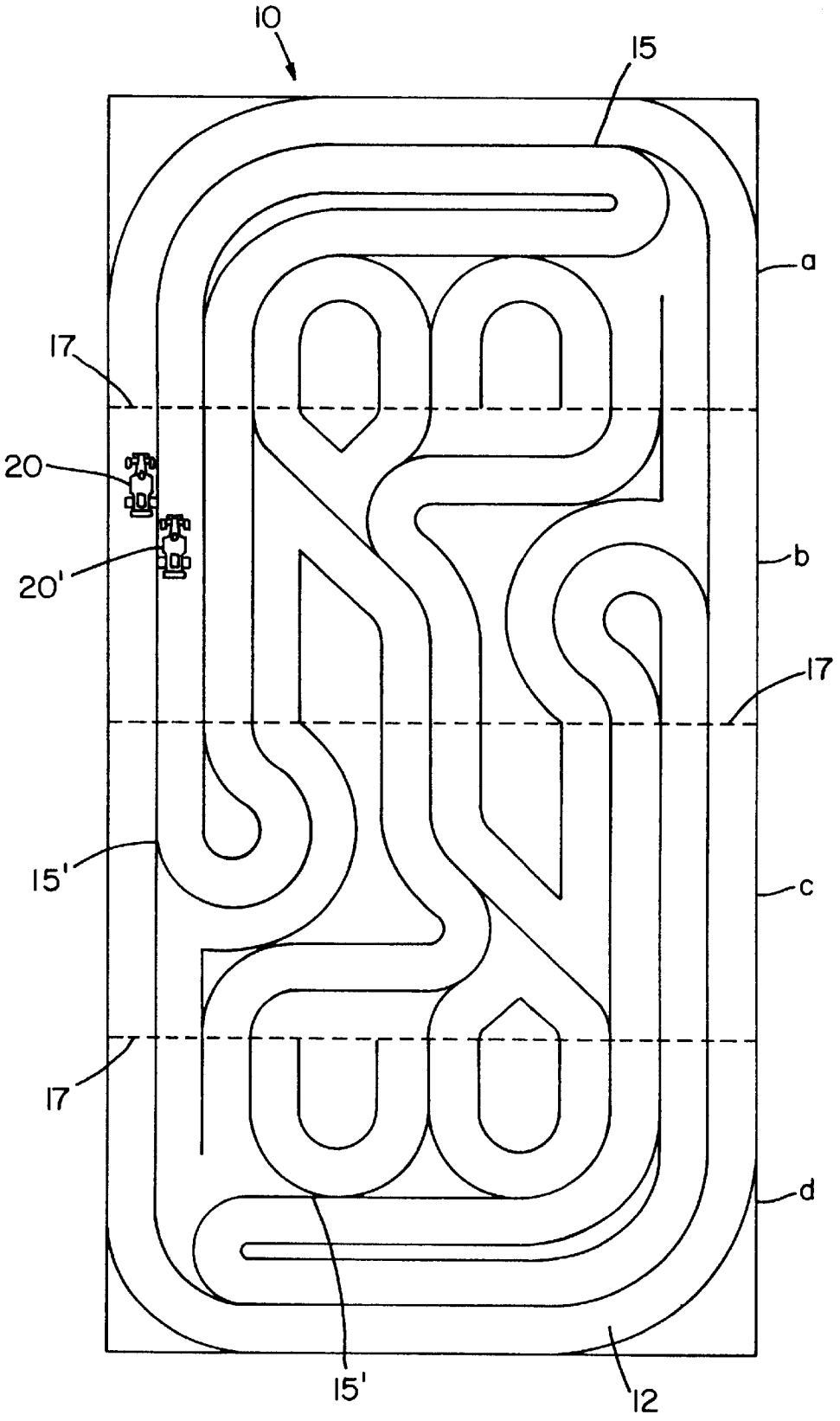
FIGS. 3 and 3A are schematic top plan views of modular raceway embodiments of the present invention.
Figure 3A:
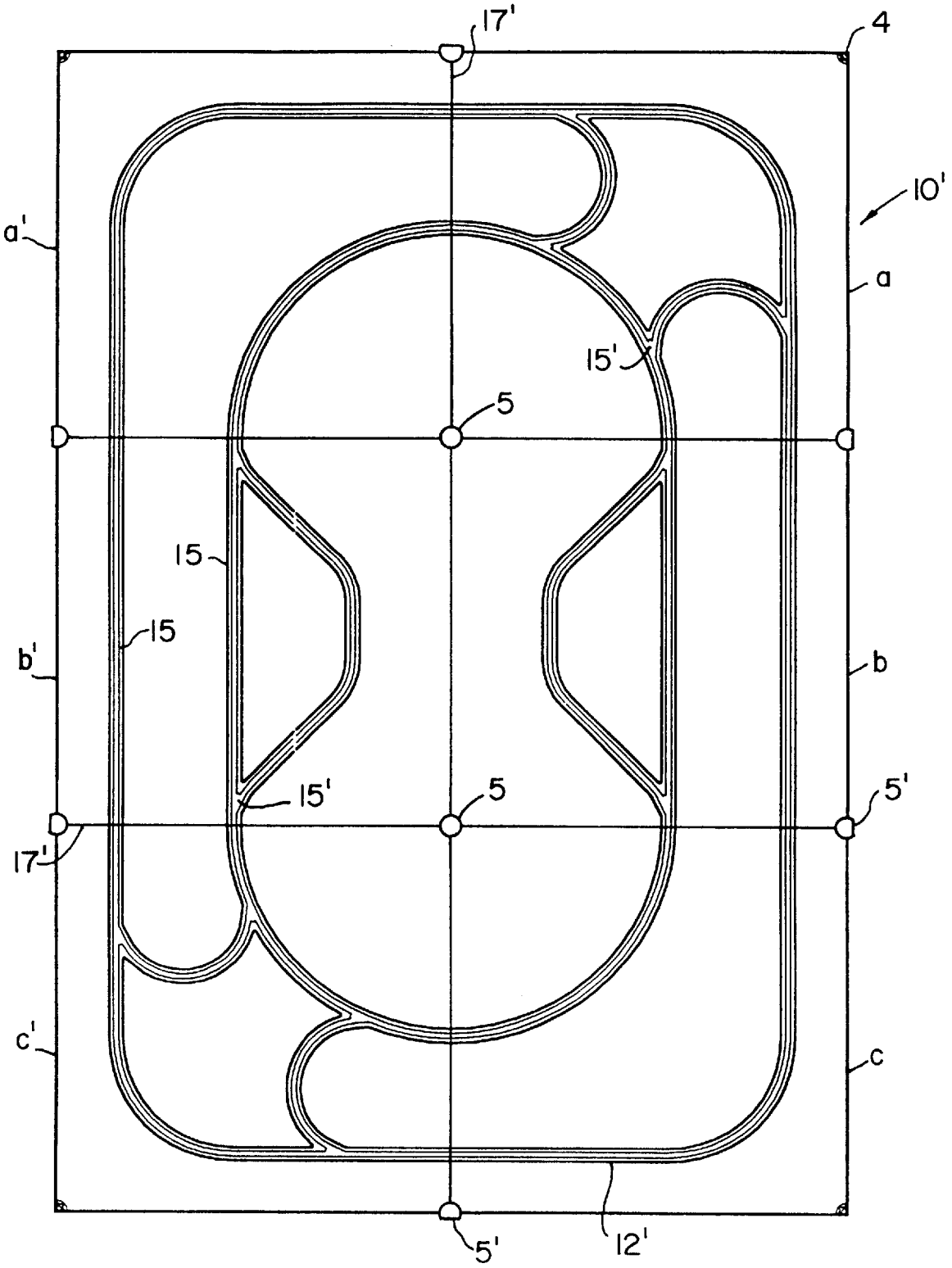

In another aspect of the invention, track game 10 can be laid out in modular snap-together panel sections as shown in FIGS. 3 and 3A. In FIG. 3 track 12 is integrally formed on modular sections a, b, c and d that fit together by known connecting means conventional to the slot car art along their respective edges represented by edge lines 17. Each panel section of the layout has a segment of the track formed thereon. As illustrated, guide slot 15 is coextensive with the raceway configuration and branches at various branch points 15 providing a plurality of raceway course configurations and giving a player a variety of course options to follow. In this way the model operator is not required to follow the same monotonous course upon each pass around the track.

It is to be noted that the modular layout embodiment is not limited to the four-section configuration illustrated. The modular embodiment of the invention contemplates the utilization of two, three, five, etc., modular sections so long as each abutting section matches to provide a track having a continuous guide slot running longitudinally on or parallel to the approximate centerline thereof. In addition, all sections when taken together form a closed loop raceway and/or guide way configuration. It is to be understood that a typical raceway does not have to be defined in terms of a road bed having defined left and right-hand edge lines or boundaries (i.e., median, berm and center lines). All that is required is a continuous guide slot (guide way) and a suitable surface on each side of the guide slot to accommodate the operation of at least one slot car. The modular sections can be mixed and matched to create a variety of different raceways or guide ways of varying length and configuration.

In the embodiment shown in FIG. 3, sections a and d are identical and sections b and c are identical. This allows for reduced tooling costs. The snap-together modular panel layout sections allow for simple and quick set-up and tear down, easy modification of layout configuration, high track density so that a long track circuit does not spread out over a wide area, and easy pick-up and storage. The modular panel sections of the layout can be manufactured from materials common to a conventional slot car track, such as, for example, plastic. When plastics are used a track segment can be easily molded onto a panel section giving a track segment that is integral with the panel section.

In the embodiment shown FIG. 3A track game 10' is laid out in six modular panel sections (layout sections) shown as a, a', b, b', and c, c'. Layout sections a through 9 are approximately square and are laid out in a 3×2 configuration.

The layout sections can be rectangular so long as the edges of adjacent sections are in coextensive abutment with each another. Track 12' is integral with the surface of the layout sections. In other words, each panel of the layout comprises a segment of track 12'. As shown in the figure, layout sections a through 9 are placed against one other so that the adjacent edges defined at line 17' of each panel are in coextensive abutment with each other. When all of the layout sections are assembled a closed loop raceway configuration is defined. An integrally formed continuous guide slot 11 runs longitudinally about (i.e., on the centerline) or parallel to the centerline of the closed loop raceway. Guide slot 15 branches at various branch points 15' providing a plurality of raceway course configurations and giving a player a variety of course options to follow.

Alternatively, the cars can be directed to follow a predetermined raceway course by placing a director piece (not shown) in the guide slot branch point. The director piece blocks one of the two guide slot pathways branching from the branch point, thereby directing the car into the unobstructed guide slot.

It should be noted that in all embodiments of this invention more than one guide slot can be formed in the track or modular layout section to accommodate a greater number of cars. In general, one guide slot can accommodate up to four racing cars. When a plurality of guide slots are provided they are spaced in parallel relationship to the longitudinal centerline of the track. The width of the track about the raceway should at least be wide enough to accommodate two cars racing side-by-side. The track width can vary to accommodate more than one guide slot.

As shown in FIG. 3A the layout can comprise three different component sections: a basic corner section, a' and c, each comprising a curved track segment; a corner section, a and c', each comprising curved track segments and return loop segments; and a basic center section, b and b', each comprising straight and by-pass track segments. Sections a' and c are identical. Sections a and c' are identical and sections b and b' are identical. When assembled into a layout the panels with integral track segments mate to provide a closed loop raceway. The track can be expanded by inserting additional center sections into the raceway configuration. Panel section connecting means shown generally at 5 and 5' can be employed to connect adjacent layout panels together. Sector recesses 4 (described in detail below) are shown at the four corners of the layout. Although a specific panel connection means is described herein, the layout sections can be connected together by any known means employed in the art.

Figure 3B:
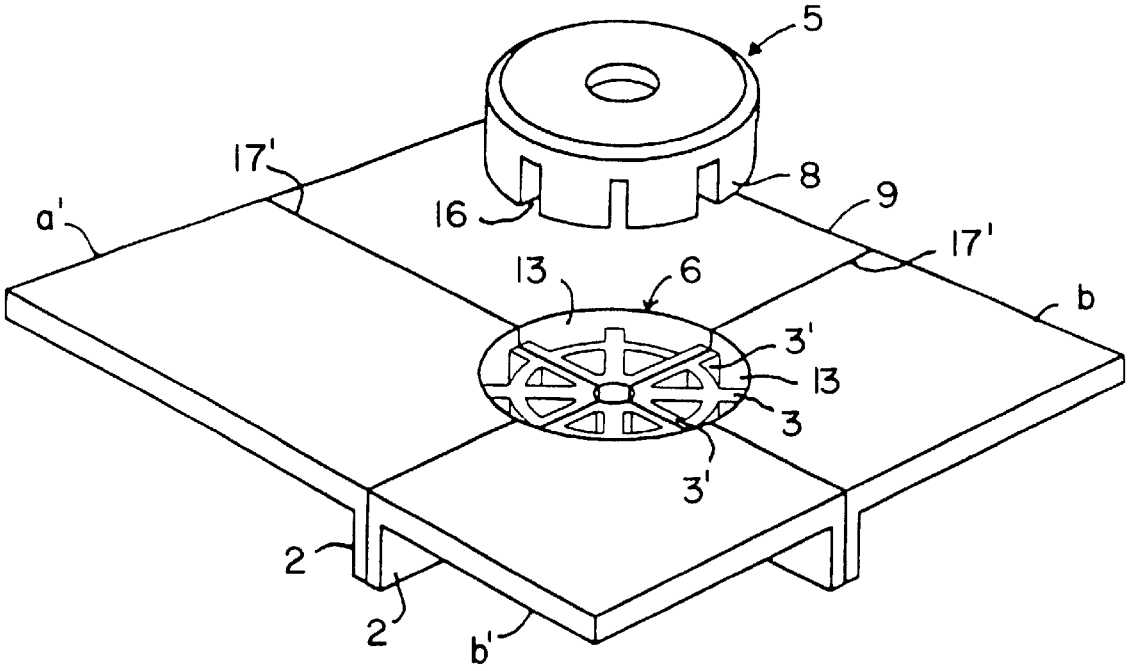
FIG. 3B is a partial perspective view of modular layout sections a, a', b, b' of the raceway shown in FIG. 3A illustrating a means for connecting adjacent interior corner sections.
Figure 3C:
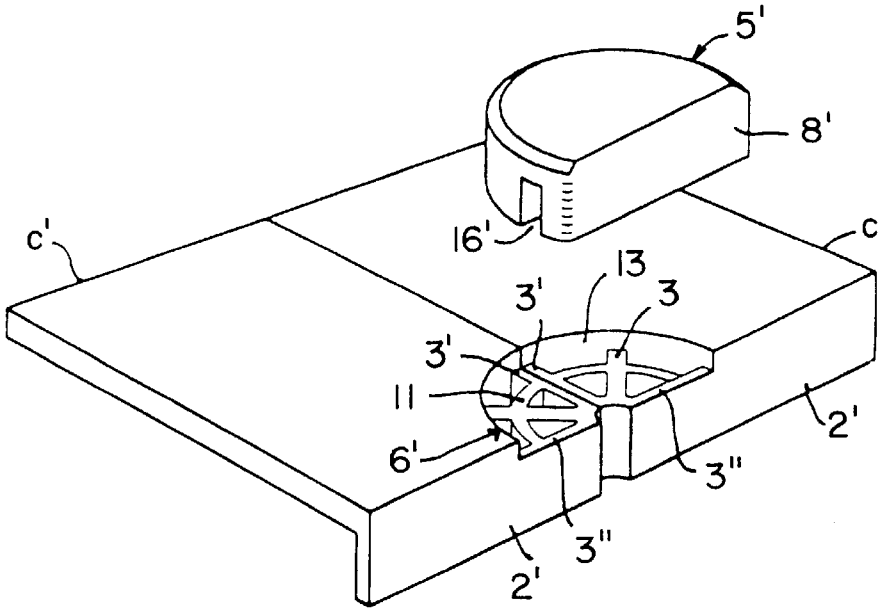
FIG. 3C is a partial perspective view of modular layout sections c, c' of the raceway shown in FIG. 3A illustrating a means for connecting adjacent exterior corner sections located about the periphery of the raceway layout.

As shown in FIGS. 3B and 3C corner clips 5 and 5' can be employed to connect abutting layout sections by a push fit engagement into mating clip recesses 6 and 6', respectively. Modular layout sections a, a', b, b' and c, c' include a downward extending leg 2, the outboard face 2' of which forms an interface for the mating abutment of adjacent layout sections. The layout sections are mated in coextensive abutment with each other along the length of leg 2.

Figure 3D:
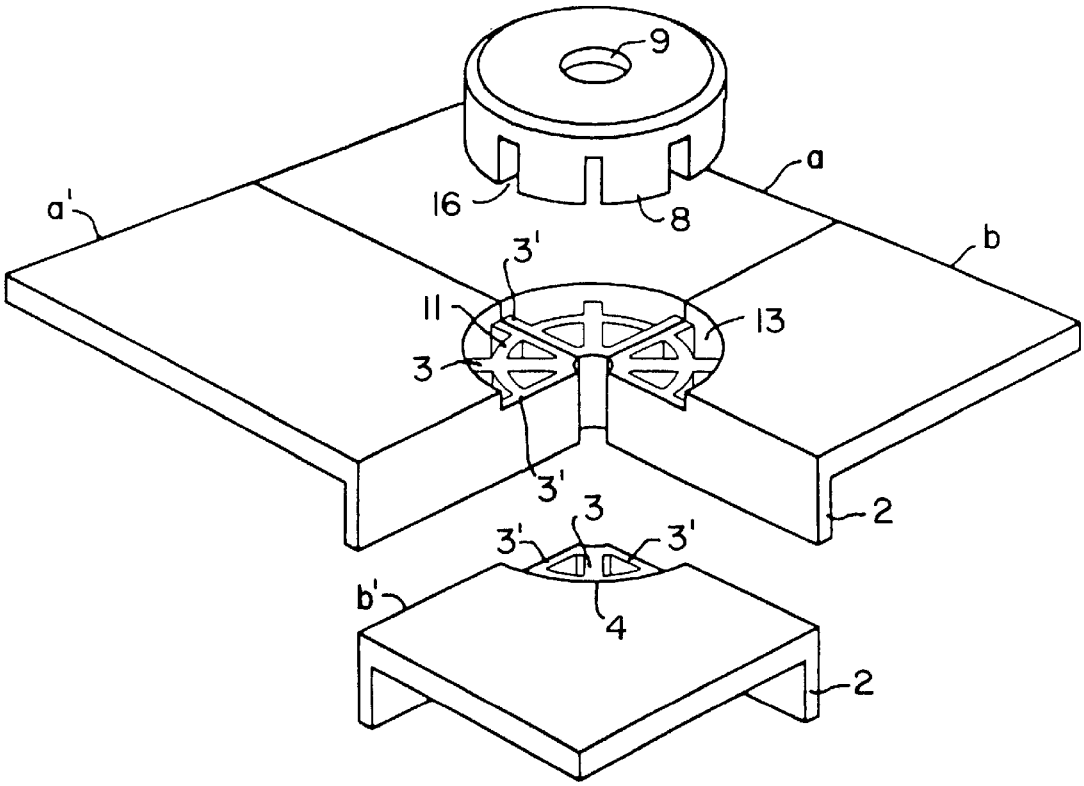
FIG. 3D is a partial perspective view of the modular layout sections shown in FIG. 3B with section b' moved out of abutting alignment with adjacent sections a, a' and b.

Although not shown in the figures, leg 2 can extend around the periphery of each panel section. Lines 17' define the interface line where the edges of adjacent layout sections are in coextensive abutment. As shown in FIG. 3D each modular section includes on a corner thereof a sector recess 4. The interior of each sector recess includes integrally formed upwardly projecting ribs 3 and rib elements 3' and sector recess wall 13. Sector recess 4 is bounded by rib elements 3' (spaced approximately 90° apart) and the sector wall 13. Rib elements 3' form the radii of the sector recess and sector wall 13 forms an arc therebetween. Rib elements 3' are an integral extension of leg 2. An integral upwardly projecting interconnecting ridge element 11 forms a second smaller arc between rib elements 3'. Sector wall 13 and ridge element 11 lie on parallel arcs. Rib 3 bisects the arcs formed by the sector wall and ridge element 11. Clip recesses 6 and 6' are formed by the side-by-side placement of sector recess sections 4. As panels are aligned in coextensive abutting relationship, the contiguous comers of four panels, each having a sector recess integrally formed thereon, align to form circular recess 6 (see FIG. 3B). Contiguous exterior comers of two adjacent panels (i.e., corners located on the periphery of the layout) form semicircular clip recess 6' (see FIG. 3C). When four panel sections are placed in abutting side-by-side coextensive engagement, rib element 3' of one panel section is in coextensive abutment with rib element 3' of an adjacent section (see FIG. 3B). When two panel sections are placed in abutting coextensive engagement, rib element 3' of one panel section is mated with its counterpart from the other panel section. While one rib element 3 "(being on the outer periphery) on each section remains unmatched (see FIG. 3C).

Figure 3E:
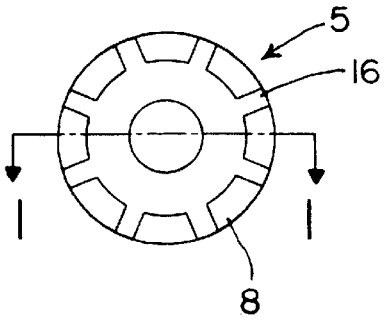
FIG. 3E is an underside plan view of the circular connecting clip shown in FIGS. 3B and 3D.
Figure 3G:
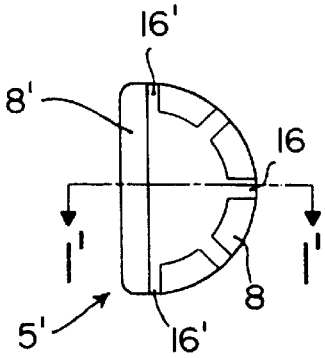
FIG. 3G is an underside plan view of the semicircular connecting clip shown in FIG. 3C.
Figure 3F:
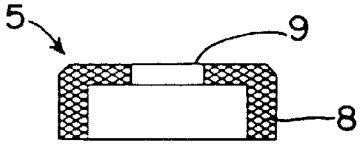
FIG. 3F is a cross sectional view taken through line 1—1 of the circular clip shown in FIG. 3E.
Figure 3H:
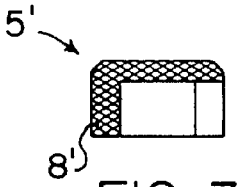
FIG. 3H is a cross sectional view taken through line 1'—1' of the clip shown in FIG. 3C.

Referring to FIG. 3E, tabs 8 of corner clip 5 are configured to be received in the space bounded by the walls of rib elements 3 and 3', sector wall 13 and ridge element it. Tab recesses 16 of clip 5 are adapted to receive the upwardly projecting ribs 3 and mated rib elements 3' from adjacent panel sections. When the corner clips are pushed into the recess 6 the mated rib elements 3' from adjacent modular sections are gripped securely together in interlocking engagement with tab recesses 16. Aperture 9 of clip 5 facilitates the removal of the clip from recess 6. The same interlocking relationship holds for clip 5' shown in FIG. 3C except that the unmated rib elements 3" are received in recess 16' of clip 5' and clamped between tabs 8 and tab 8' shown in FIG. 3G and 3H.

Clips 5 and 5' function in tandem to connect the modular layout panels together. The mating engagement of clip 5 with clip recess 6 and clip 5' with clip recess 6' provides a strong connection that resists bending and shear forces and facilitates the relocation and storage of the entire layout as a unitary mat like structure. The entire raceway layout 10' can be hung on a wall for storage. When play is resumed the unitary structure is simply taken down from the wall and placed on a stable, flat playing surface such as a floor or table. To facilitate easy expansion of the raceway layout, it is preferable that each corner of every modular layout panel have a sector recess integral therewith. In this way the raceway can be expanded by inserting additional section panels into the layout. The only proviso being that the track segments on adjacent panel sections are contiguous (track segment end to track segment end) and form a closed loop raceway with a continuous guide slot when the layout is finally assembled.

The corner clips and raceway layout panel sections are preferably molded from plastic.

Figure 4:
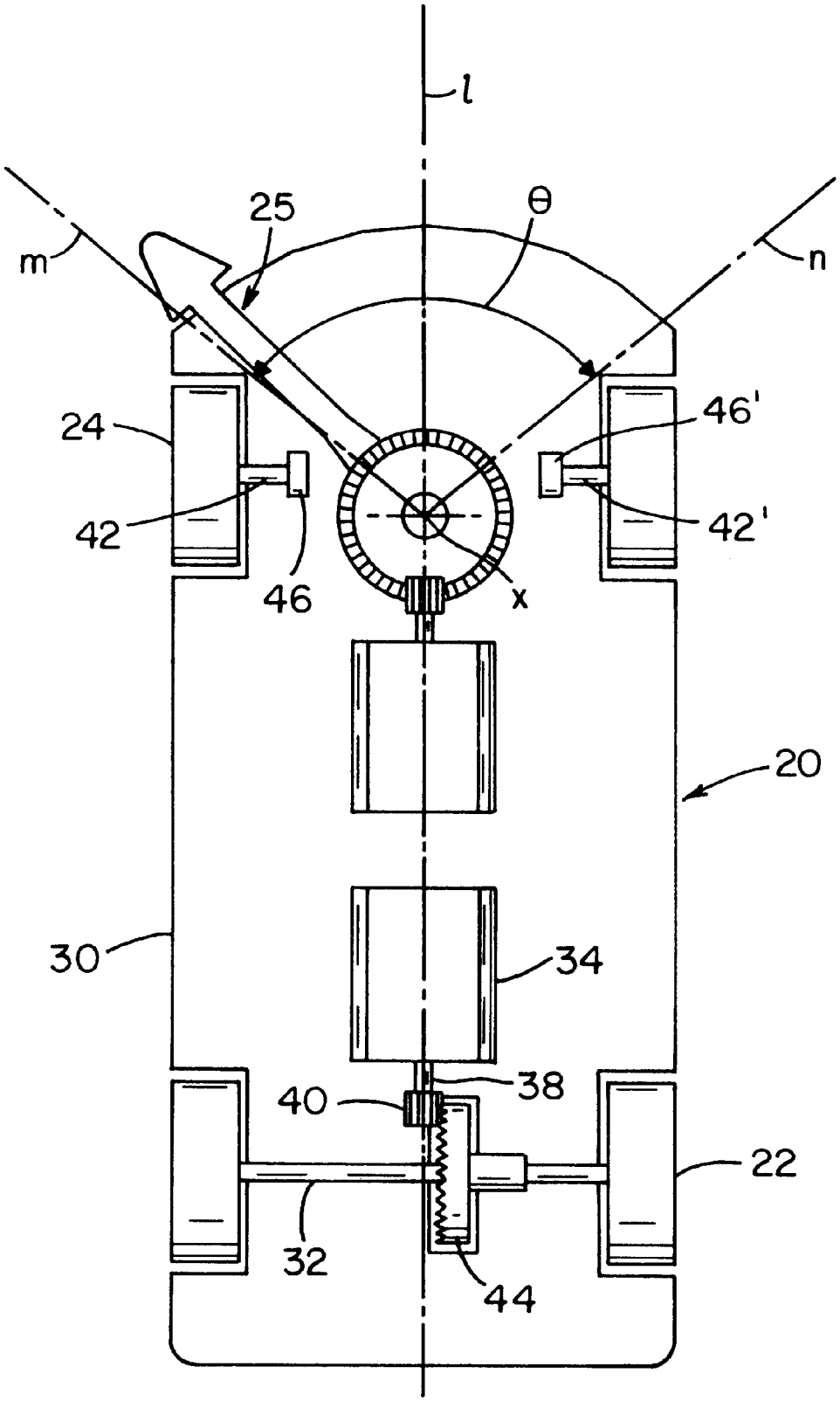
FIG. 4 is a schematic top plan view of a model racing vehicle showing the arc of rotation of the guide arm according to the present invention.

Referring to FIG. 4, the model racing vehicle 20 with guide arm means utilized in conjunction with the raceway described hereinabove includes a chassis or floor pan 30, a vehicle body (not shown) mounted on the chassis, a pair of rear and front wheels 22 and 24, respectively, rotatably mounted to the chassis, and a vehicle guide arm 25 that is pivotally mounted to the underside or topside of chassis 30. The wheels 22, 24 are covered with a plastic or a rubber material having a high coefficient of friction with the raceway surface. Preferably, the side walls of wheels 22, 24 are constructed from a low friction material accommodating the sliding engagement of the wheels of one vehicle with the guide arm, body and/or the wheels of an opponent racer as the cars jockey for position about the raceway as in an actual stock car race. The vehicle body can be of any desired configuration, such as, a stock car, open wheel race car, or truck. Chassis 30 and the vehicle body can be of any convenient material of construction with plastic being the material of choice. The body can be mounted to the chassis in any convenient manner, such as, for example, by snap fitting or by fastener attachment. Chassis 30 can be configured to include a plurality of vertical walls, extensions, depressions, indentations and openings (not shown), and the like for accommodating, mounting and/or housing various vehicle components, such as, gears, motors, axles, wheels, batteries, and electronic components, as well as to facilitate the mounting and fastening of the vehicle body thereto. Rear wheels 22 are secured to opposite ends of rear axle 32. Rear axle 32 is rotatably mounted to chassis 30 and drivingly connected to drive motor 34 through suitable drive transmission means. The drive transmission utilized for the drive connection between the drive axle and drive motor can be of any conventional configuration commonly employed in model racing vehicles.

The drive linkage means illustrated includes a pinion gear 40 that is drivingly secured to drive shaft 30 of motor 34. Drive shaft 38 and pinion gear 40 are perpendicular to rear axle 32. Pinion gear 40 is meshingly engaged with as axle face gear 44 which is secured to rear axle 32. Preferably, drive motor 34 is a direct current (DC) electric motor commonly utilized in slot car games.

The forward end of chassis 30 includes unpowered or driven front wheels 24 rotatably mounted thereto. Any suitable mounting means for rotatably mounting the front wheels to the chassis will suffice in the practice of the present invention. In the embodiment shown, wheels 24 are rotatably mounted to the ends of a stub axles 42, 42'. The opposite ends of the stub axles are fixed to chassis 30 by means of axle mounting bosses 46, 46'. The mounting bosses can be integrally formed with the chassis. The chassis mounting ends of the stub axles can be splined to be fixedly secured into mounting apertures (not shown) in the mounting bosses. In another embodiment, a unitary front axle spanning the width of the racer with wheels 24 rotatably mounted on opposite ends can be mounted to chassis 30 by conventional means.

Figure 5:
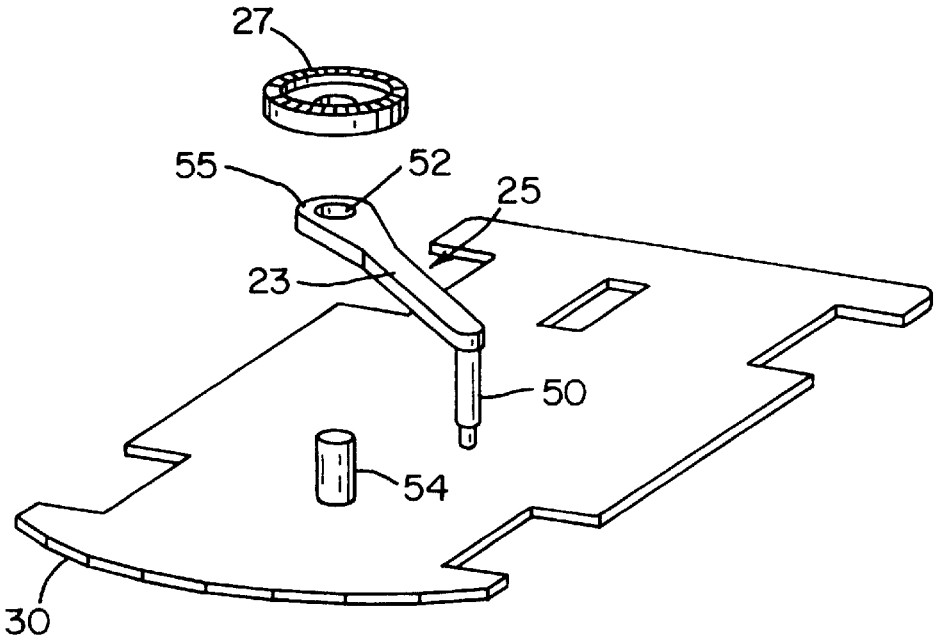
FIG. 5 is an exploded perspective view of the guide arm mechanism shown in FIG. 4.

As discussed hereinabove the model vehicle of the invention is maneuvered about the raceway via an operator controllable guide arm which is in sliding engagement with a guide slot formed into the surface of a raceway. Referring to FIG. 5, guide arm 25 includes an elongate extension 23 that terminates at an end thereof into a pivot end generally indicated at 55. The pivot end 55 of guide arm 25 includes aperture 52 for pivotally mounting the guide arm to chassis 30 of the vehicle. At the distal end (i.e., the end opposite pivot end 55) of guide arm 25, a guide pin 50 downwardly depends therefrom. The pivot arm 25 is pivotally mounted to the chassis through pivot shaft 54 which is integrally formed with chassis 30. The guide arm is rotatably mounted on pivot shaft 54 through aperture 52 at pivot end 55 thereof. Aperture 52 is slightly larger than the diameter of pivot shaft 54 to facilitate the free rotation of the guide arm about the vertical axis thereof.

Pivot end 55, of guide arm 25 is pivotally (by means of pivot shaft 54) mounted to chassis 30 at a pivot point generally indicated at x (see FIG. 4). Pivot point x is preferably located on the longitudinal centerline of chassis 30 behind front axles 42, 42'. The ideal longitudinal placement of the pivot point is a function of the car geometry (i.e., wheelbase and track width). If the pivot point is located too far to the rear of the car or if the guide pin is too close to the drive wheels, then the model vehicle assembly becomes unstable and the vehicle will not travel along the guide slot. The guide arm is adapted to rotate (by means to be described below) about a vertical axis through the pivot point. The angle of lateral rotation, θ, of guide arm 25 is through an arc of approximately 100°, i.e., 50° on each side of the longitudinal centerline, i, of the chassis 30. From the figure it is apparent that the pivot point must be placed at a location on the longitudinal centerline to permit the guide arm to rotate through its maximum arc of rotation (bounded approximately by lines m and n) without being encumbered by the front wheels. The guide pin 50 is positioned on the distal end of elongate extension 23 such that it extends beyond the side of the car body by at least a distance approximately equal to half the width of the guide slot of the raceway.

In this way the guide pin is assured of clearing the sides of the car body as it moves through its arc of lateral rotation. All of the elements of guide arm 25 can be integrally formed from any convenient material of construction with plastic being the material of choice.

Figure 6:
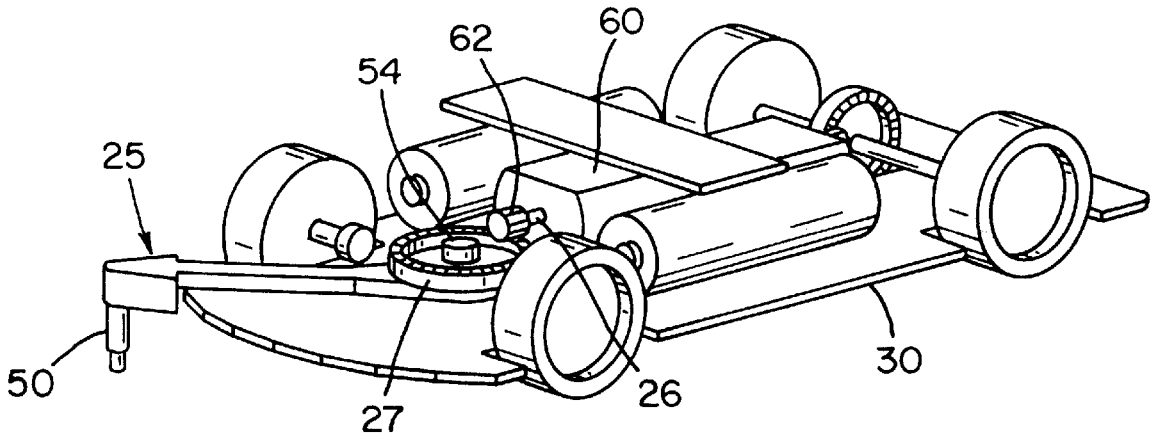
FIGS. 6 and 7 are perspective views of the model racing vehicle of the present invention.

In the embodiment shown in FIG. 6, guide arm 25 is actuated by guide arm actuation motor 60 which is mounted to chassis 30 and drivingly connected to the guide arm by pinion gear 62 and actuation gear means hereinbelow described. Guide arm drive or actuating motor 60 is mounted on the top surface of chassis 30. Guide arm motor pinion gear 62 is secured to the motor shaft 26 of guide arm actuating motor 60. Pinion gear 62 meshingly engages a crown gear 27 which is rotatably mounted on the pivot shaft 54 above guide arm 30 (see FIG. 5). Crown gear 27 is rotatably mounted on pivot shaft 54 in the same manner as described for the guide arm 25 above. Crown gear 27 is securely fixed to guide arm 25 by suitable connection means to insure that both the crown gear and guide arm pivot as a single unit about the vertical axis of pivot shaft 54. Suitable connection means between the crown gear and guide arm include a downwardly projecting key or pin (not shown) from the bottom face of crown gear 27 that is received in a corresponding keyway, recess or aperture (not shown) on the top surface of the pivot end 55 of guide arm 25. The crown gear 27 is sized so that the time taken to drive guide arm 25 through its maximum arc of rotation ranges from about 0.01 to about 1 second and, preferably, from about 0.1 to about 0.5 seconds.

The guide arm can be formed independently of crown gear 27 as shown in FIG. 5, or the guide arm and crown gear can be integrally formed as a single unit. A grill slot opening can be located in the front of the vehicle body to allow the distal portion of the guide arm to protrude through and clear the front of the car body and accommodate the lateral movement of the arm.

To restrict or keep the extent of movement of guide arm in all embodiments of the invention to within the desired arc of rotation, any suitable limiting means (not shown) can be adapted to work in concert with the guide arm and/or the actuating means. For example, limit stops or limit switches can be located at a desired location along lines m and n (see FIG. 4) such that the engagement of the guide arm 25 against the limit stop or switch will limit the pivotal movement of the guide arm there beyond. Alternatively, limit means can be located on crown gear 27 such that when guide arm 25 reaches its maximum position (i.e., 50 to either side of centerline 1, said limit means will limit the movement of the guide arm.

Figure 5A:
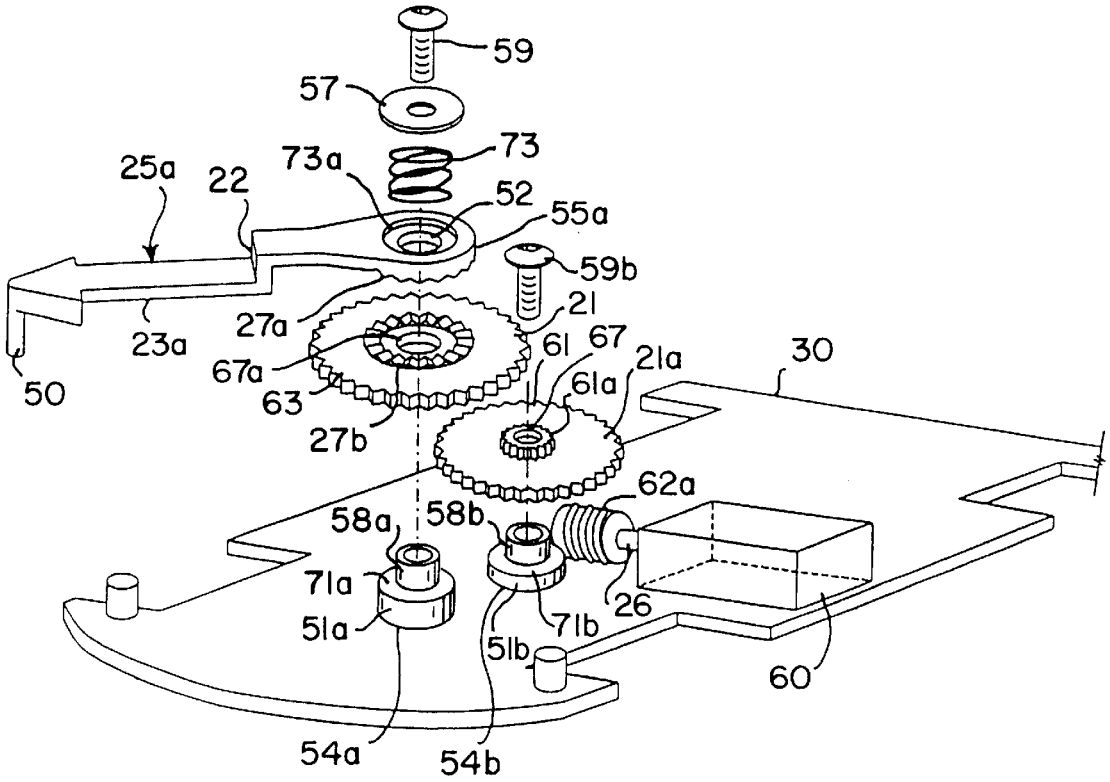
FIGS. 5A and 5B are partial perspective views of the actuating arm drive gear and torque limiting clutch mechanism.
Figure 5B:
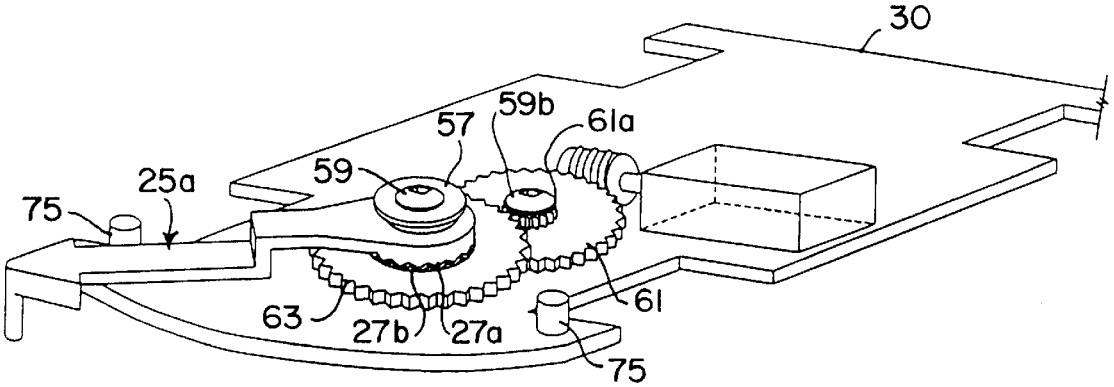

In another embodiment of the invention, the guide arm is driven by the guide arm actuating motor through a series of gears. A spring loaded torque limiting clutch mechanism is included to prevent the guide arm from overloading the motor when it reaches its limit stops. In the embodiment shown in FIGS. 5A and 5B, guide arm 25*a* is drivingly connected to guide arm actuating motor 60 by means of a series of spur gears 61, 63. Guide arm 25 includes an elongate extension 23*a* that terminates at one end thereof into a pivot end generally indicated at 55*a*. Pivot end 55*a* includes downwardly projecting clutch teeth 27*a*. The distal or opposite end of extension 23*a* includes downwardly projecting guide pin 50. Gear 61 includes concentric spur gear 61*a* integrally formed and fixed on the top face 21*a* thereof. Spur gear 61*a* is smaller in diameter than spur gear 62. Spur gear 61 is rotably mounted on cylindrical boss 54*b* having base portion 51*b*, step portion 71*b*, and shaft 58*b*. Step 71*b* lies in a plane parallel to chassis 30. Spur gear 61 is rotably mounted about shaft 58*b* of boss 54*b* and against step 71*b* thereof. Screw 59*b* passes through aperture 67 located in the center of concentric gears 61 and 61*a* and engages a threaded screw recess (not shown) formed along the vertical axis of shaft 58*b* to secure gear 61 in place. Boss 54*b* is integrally formed on the top surface of chassis 30. Guide arm actuating motor 60 is mounted to chassis 30. Worm gear 62*a* is rotably fixed to the drive shaft 26 of the guide arm actuating motor. Worm gear 62*a* is meshingly engaged with the teeth of spur gear 62. Spur gear 61*a* meshingly engages spur gear 63. Spur gear 63 having centrally located aperture 67*a* is rotably mounted on cylindrical boss 54*a* having base portion 51*a*, step portion 71*a*, and shaft 58*a*. Step 71*a* lies in a plane parallel to chassis 30. Spur gear 63 is rotably mounted about shaft 58*a* of boss 54*a* and against step 72*a* thereof. Boss 54*a* is integral with the top surface of chassis 30 and is located on the pivot point of the chassis as described in the foregoing embodiments. The height of the base portions of bosses 58*a* and 54*b* can be adjusted to accommodate the meshing engagement of various gear types and sizes. As shown in the figures elongate arm 23*a* is stepped upwards at 22 to accommodate the height of the mounting boss.

Spur gear 63 includes concentrically arranged clutch teeth 27*b* upwardly projecting from its top face 21. The upwardly projecting clutch teeth 27*b* and the downwardly projecting clutch teeth 27*a* of guide arm 25*a* are in interlocking contact with each other. Clutch teeth 27*a* of guide arm 25*a* are downwardly biased against clutch teeth 27*b* of spur gear 63. A clutch spring 73 is compressed into spring recess 73*a*. Spring recess 73*a* is concentrically located about aperture 52 on the top surface of pivot end 55*a* of the guide arm. The spring is biased downwards by spring retaining washer 57 and torque adjusting screw 59. Torque adjusting screw 59 passes through spring retaining washer 57, clutch spring 73, aperture 52 of guide arm 25*a*, through gear 63, and engages within boss 54*a*. A threaded screw recess (not shown) is formed along in the vertical axis of shaft 58*a* to receive the adjusting screw. The bias tension on the spring can be changed by adjusting the position of the torque adjusting screw 59. The interlocking and biased engagement of clutch teeth 27*a* with clutch teeth 27*b* allow spur gear 63 and guide arm 25 to rotate as a single unit under normal torque conditions. The clutch teeth on guide arm 25*a* and spur gear 63 are triangularly configured. The interlocking biased arrangement of clutch teeth transmit a torque as a function of the angle of the teeth and the force of the spring. When an overload torque is reached the wedge action of the clutch teeth against each other move the guide arm upwards until teeth 27*a* and 27*b* become disengaged from each other, preventing the transmittal of damaging or unnecessary torque to the actuating motor when the guide arm reaches and is forced against limit stops indicated at 75. When the overload torque subsides the biased clutch teeth are forced to reengage in interlocking relationship. As set forth in the description under FIG. 4 the limit stops can be located along the radii (lines M and a) of the desired arc of rotation of the guide arm. In the embodiment shown in FIG. 5B limit stops 75 are pegs that project upward from chassis 33.

Figure 7:
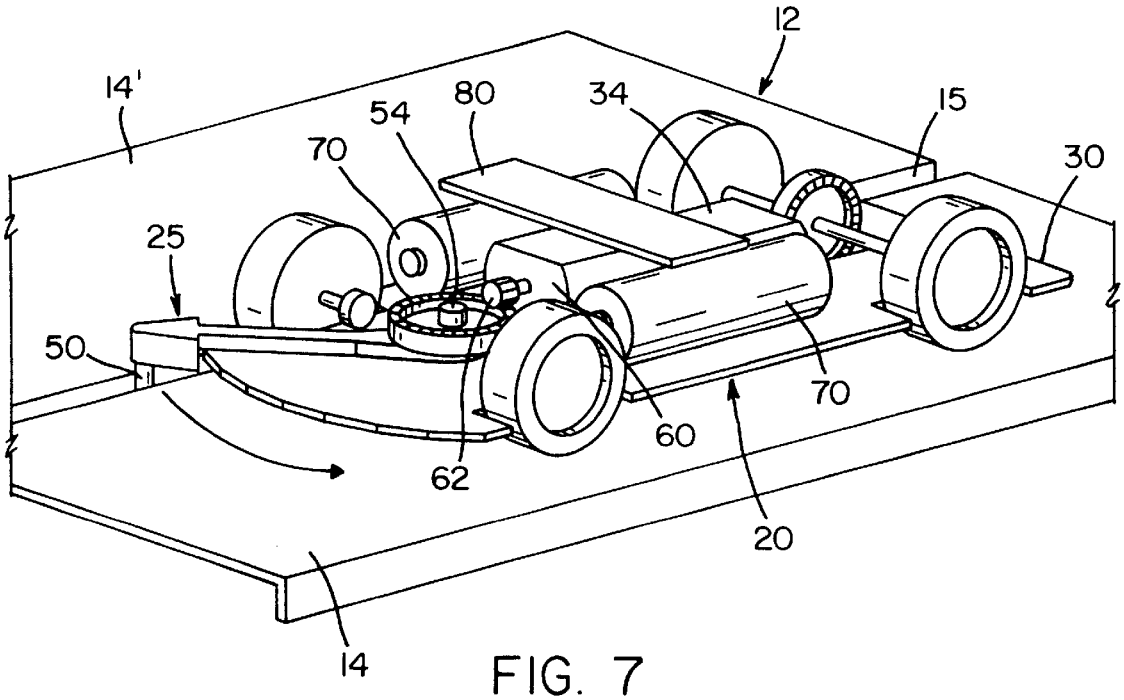
Figure 8:
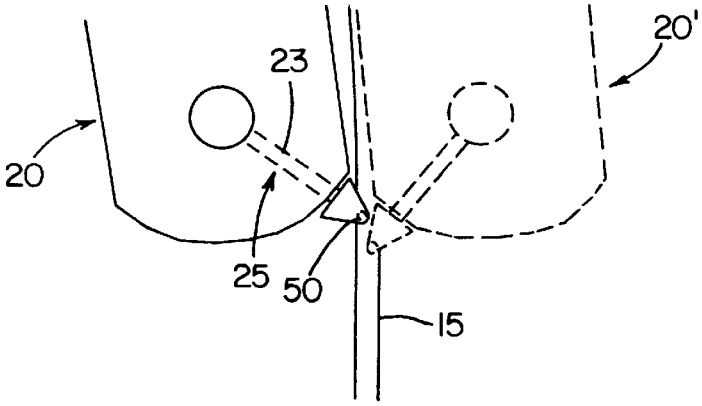
FIG. 8 is a partial schematic top view of two racing vehicles of the invention showing the interaction of the guide arm mechanisms within a guide slot.

The guide arm actuation motor 60 is a direct current (DC) motor so that when a DC voltage of a first polarity is applied to the motor, the motor is energized with a particular polarity (dictated by the control system) and rotates in a first direction. When a voltage of an opposite polarity is applied to the motor, the motor is energized with the opposite polarity causing it to rotate in the opposite direction. For the sake of illustration (see FIG.7), as model race vehicle 20 is driven forward on lane R4 of track 12, motor 60 is actuated so that pinion gear 62 rotates in a clockwise rotation. The clockwise rotation (facing the pinion gear from the front of the car) of pinion gear 62 effects the counterclockwise rotation of crown gear 27 causing guide arm 25 to pivot to the left side of the car (in the direction of the arrow) forcing guide pin 50 against the left wall of guide slot 15. The force placed against the left wall of the guide slot (relative to the direction the car is facing) by guide pin 50 effects the lateral displacement of race vehicle 20 into the right lane 14' of track 12. In this way maneuvering of the model vehicle from one side of the guide slot to the other is effectuated. To maneuver the race vehicle back into lane 14 from lane 14' the reverse procedure would be executed (i.e., motor 60 would be actuated to run in a counterclockwise rotation). In all embodiments, guide slot 15 in track 12 must be wide enough to accommodate the side by side engagement of two guide pin elements as one vehicle overtakes and passes another as shown in FIG. 8. In addition, guide slot 15 must be deep enough as to assure the retention of guide pin 50 therein during the forward and lateral movement of the model racing car. To facilitate the sliding action of one guide arm past another as one vehicle overtakes and passes another, the distal end of elongate extension element 23 of guide arm 25 can be shaped in the form of an arrowhead.

Figure 9:
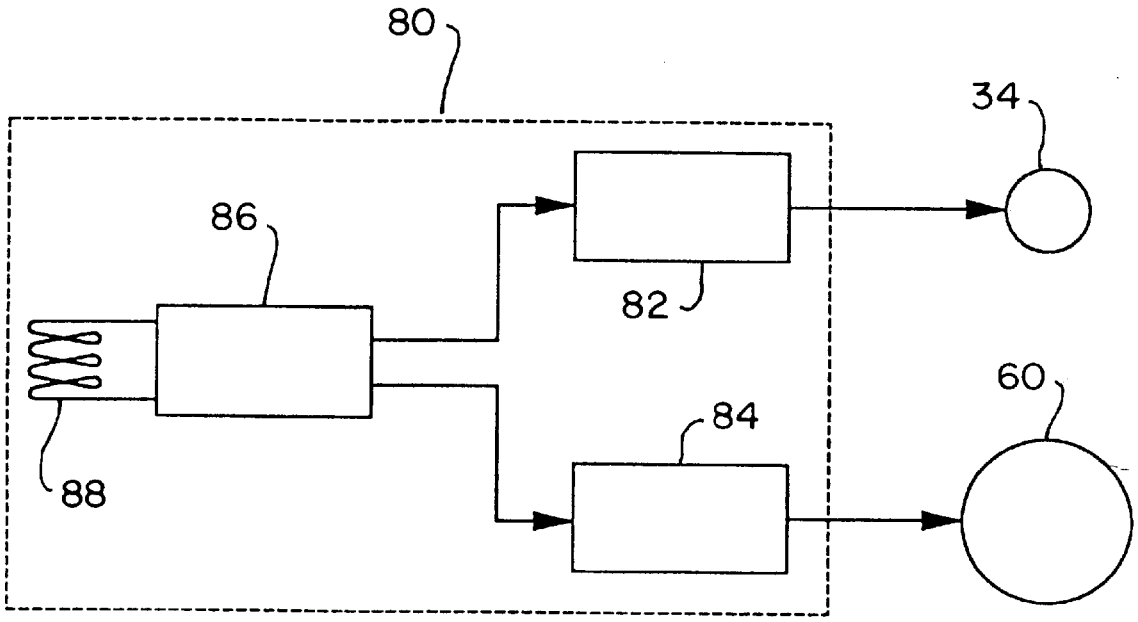
FIG. 9 is a circuit block diagram of a control circuit for actuating the drive and guide arm motors of the present invention.

Referring now to the power and control means for the racing vehicles of the present invention, the vehicles can be self-powered through an on board battery source and remotely controlled by means of radio transmitter/receiver. In another embodiment, the vehicles can be powered and controlled by means of power/control strips (busbars) located on the surface of the track wherein the power is supplied by a DC power source. In the first embodiment, drive motor 34 and guide arm control motor 60 are energized by an on board battery pack 70 as shown in FIG. 7. Battery pack 70 can be mounted to chassis 30 in any convenient manner. The battery pack or batteries 70 can be a rechargeable NiCad battery commonly utilized to power remotely controlled model vehicles. Control of motors 34 and 60 is provided by a control circuit 80 via a hand held radio control transmitter (not shown). The radio control transmitter and control circuit 80 are conventional to the art of remotely controlled model racing vehicles. The circuit 80 is adapted for independent control of drive motor 34 and guide arm control motor 60 as shown in FIG. 9. FIG. 9 illustrates an embodiment of control circuit 80 including a receiving circuit 86 having a pick-up coil 88 for receiving operational instructions from a radio signal transmitter (not shown) that is operated by a player. The receiving circuit 86 receives a motor drive control signal to control motor driving circuit 82 for actuating and regulating the speed of the drive motor 34. Operational instructions for controlling guide arm control motor 60 are also received in the receiving circuit 86 and are transmitted to guide arm control circuit 84 to energize and effect polarity changes to guide arm control motor 60, causing the guide arm to pivot with the concomitant lateral displacement of the model race vehicle as described hereinabove.

An alternative embodiment includes an off-board power source wherein electrical current is supplied to the drive motor and guide arm control motor via busbars or conductive strips integral with the raceway surface. In this embodiment, electrical current is supplied through a conventional DC power source that is in electrical connection with the conductive busbars embedded on the track surface and on the bottom of the guide slot. Electrically conductive pick-up shoes on the model vehicle of the invention transfer the current to energize the drive and guide arm actuating motors, along with operator control signals to control the functions of the requisite motors.

Figure 10:
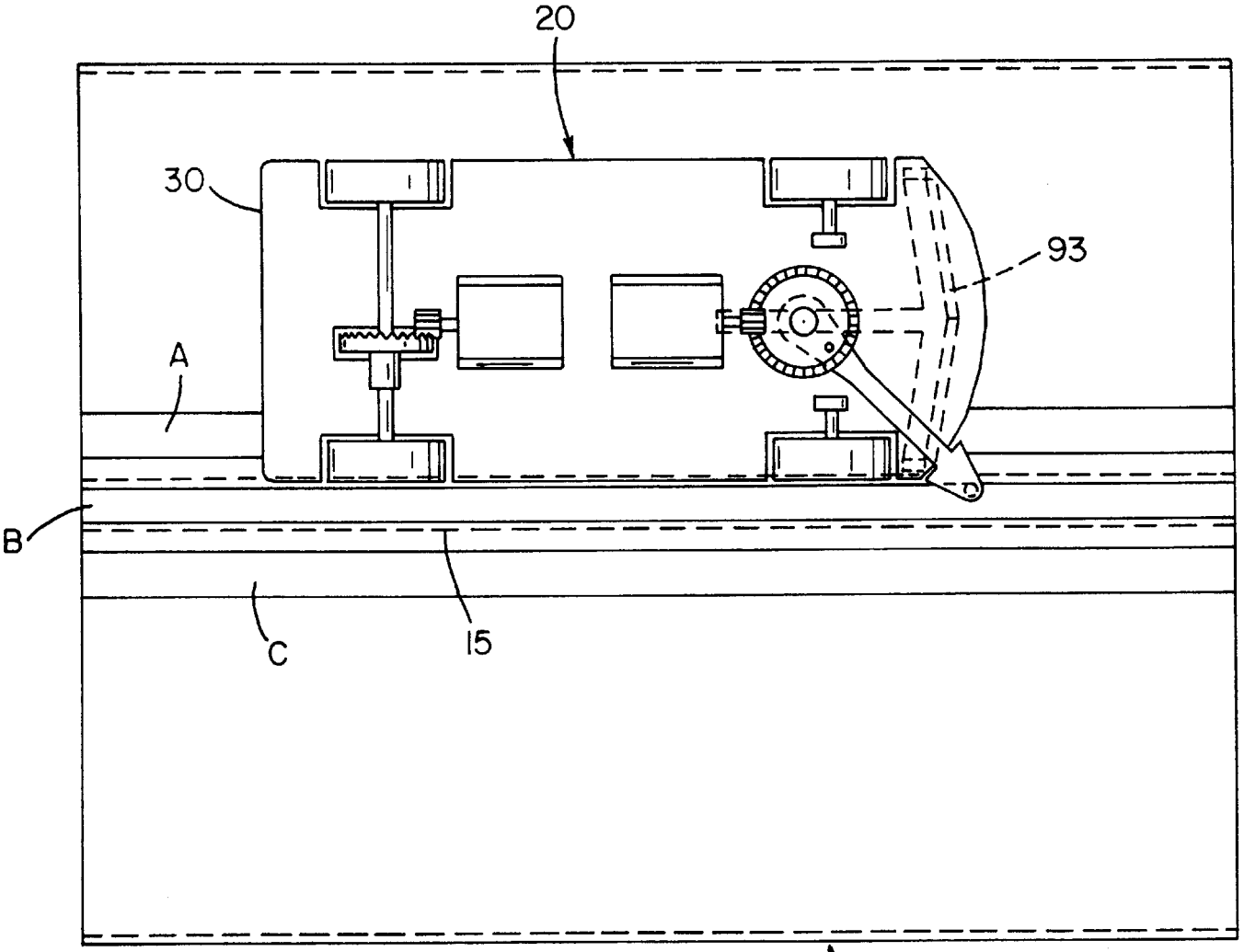
FIG. 10 is a schematic top plan view showing a section of track with busbars and a model racing vehicle with pick-up shoe.
Figure 11:
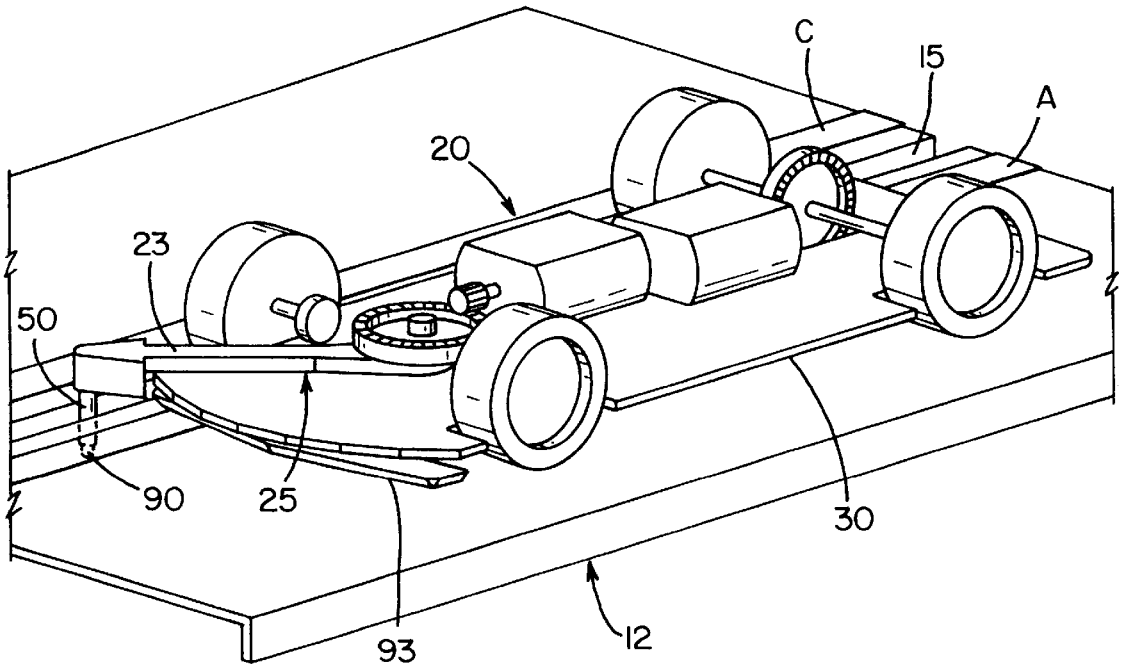
FIG. 11 is a perspective view showing a section of track with busbars and a model racing vehicle with a downwardly biased pick-up shoe on the underside of its chassis.

An illustrative embodiment of this aspect of the invention is shown in FIGS. 10 and 11. In FIG. 10 the surface of track 12 is provided with three busbars A, B and C that are generally parallel to and/or coextensive with guide slot 15. Two of the busbars, A and C, are located on the immediate surface of track 12, one on each side of the guide slot. The third busbar, 3, is recessed within the guide slot and is coextensive therewith. Busbar B can be located on the bottom surface of guide slot 15.

The busbars of the embodiments of the invention can be formed of electrically conductive metallic material, e.g., copper, aluminum, tin, brass, steel, silver, gold or any other suitably electrically conductive metal or metal alloy that provides a surface resistant to wear. Tin and tin plated electrically conductive metals are preferred because of they are inexpensive and resistant to wear. Obviously, the noble metals and alloys thereof are less desirable because of their expense and less resistance to wear. The busbars are embedded in the track so that they are substantially flush with the surface of the track and present no obstacle to movement of a model vehicle from one lane to the other. Preferably, the busbars A and C project about 0.5 mm above the track surface and are about 0.4 mm in width (at the track surface).

A DC power source (not shown) is connected to the busbars in a conventional manner known in the art for electrical slot car games. Busbars A and C conduct current of the same polarity, while the busbar 3 carries current of the opposite polarity.

As shown in FIG. 1, the bottom of guide pin 50 includes a guide pin pick-up shoe 90 that is in electrical and sliding engagement with busbar B in the bottom of guide slot 15. Chassis pick-up shoe 93 shown in FIGS. 10 and 11 is positioned on the underside of chassis 30 and extends across the width thereof so that it always remains in electrical and sliding contact with busbars A and/or C. Pick-up shoes 90 and 93 are downwardly biased assuring continual electrical contact with the busbars. In an alternative embodiment, the distal end of elongate extension 23 of guide arm 25 can be adapted to receive a pick-up shoe (not shown) for engagement with busbars A and C.

When two cars are engaged on the raceway they share the same constant voltage supply. The speed and direction control of each car is provided by a controller that encodes and modulates a control signal which is filtered and decoded by the on board control circuit. The respective arrangement and electrical polarities of busbars A, B and C insure that two or more of the model vehicles of this embodiment can simultaneously travel in the same lane (i.e., on the same side of the guide slot). It is contemplated within the scope of this invention that more than one raceway slot with associated busbars can be provided to accommodate more cars.

As will be readily recognized by those skilled in the art, a suitable control mechanism for controlling and powering the cars of the busbar embodiment of the invention is a variation of a multiple locomotive digital control system employed in the model railroading art. A suitable digital controller is commercially available as model no. QLW 61/62 manufactured by Maplin Electronics PCL, Essex, England. Such a control system is schematically illustrated in the block diagram shown in FIG. 12.

Figure 12:
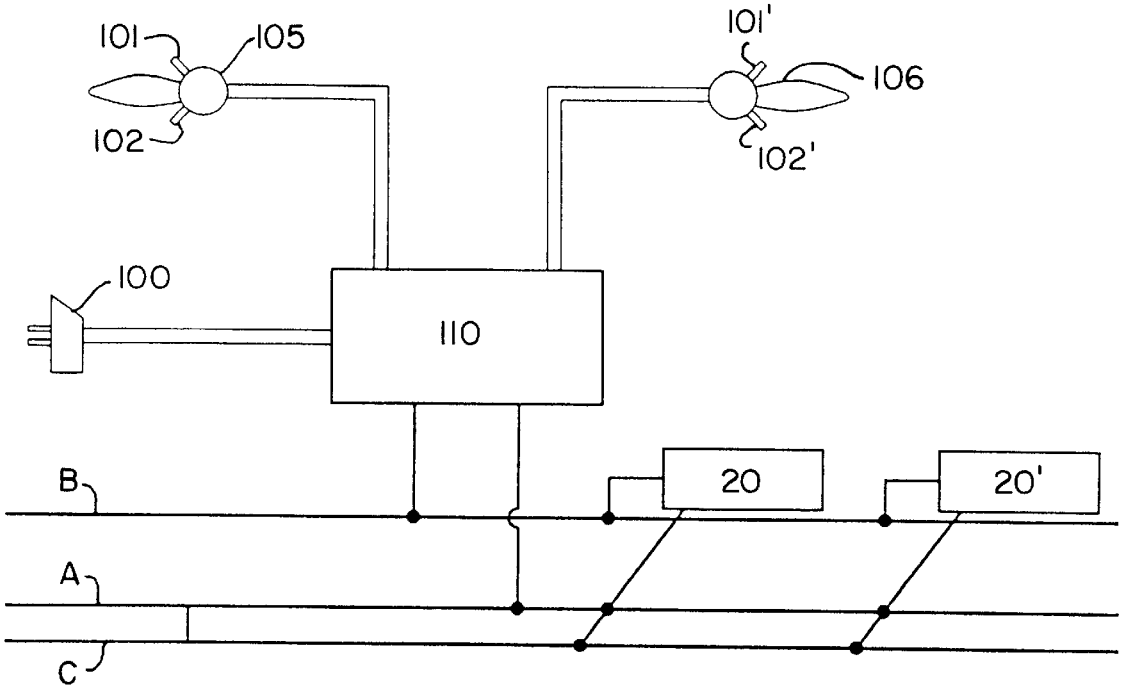
FIG. 12 is a block diagram illustrating a control circuit for the busbar embodiment of the invention.

In FIG. 12 cars 20, 20', hand held control units 105, 106 having speed control and directional control levers 101, 101' and 102, 102', respectively, and track based transmitter a 1 contains integrated circuits (not shown) for sending, receiving and executing command signals. Control units 105 and 106 are in electronic/electrical connection with transmitter 110. DC power source 100 supplies electrical power to transmitter 110 and ultimately to the cars 20 and 20 through busbars A, B, and C. The transmitter 110 is powered to approximately 16 volts (2v to 24v range) and is in electronic/electrical connection with busbars A, B, and C. Approximately 50 times per second transmitter 110 polls controllers 105, 106 to determine the position of the speed control levers 101, 101' and directional control levers 102, 102'. Based upon the position of the speed and directional control levers, the transmitter sends a coded signal superimposed on the voltage to track busbars A, B and C. The coded signals from each of the controllers is transmitted during a brief reversal of the track voltage to provide a clear window through which the signal data is transmitted. This also simplifies demodulation which can be effected by a simple diode located on a circuit decoder board in each car. The voltage reversal is brief enough that there is no effect on the speed of the cars.

The electrical contacts between the pick-up shoes (not shown) on the cars and the busbars, as well as the drive motors and guide arm control motors (not shown), produce electronic noise. This can be minimized by employing parity bit checking which rejects the signal data if an error is detected. Signal differentiation between cars can be achieved by transmitting the signal data during a predetermined time window for each car. The time window can be set up by an initiating start bit. Command signals are interpreted by an integrated circuit decoder in each car. Power in each car is varied by pulse width modulation of the power to the drive motor. The guide arm control motor is actuated by providing current to the motor for sufficient time (approximately 0.2 seconds) to move the guide arm (not shown) from one side of the car to the other.

In another embodiment transmitter 110 can be set up for data input capability to simulate a variety of racing conditions. Steering response time and car acceleration can be varied through command and control signal processing to simulate adverse weather and track conditions. For example, car handling and acceleration would vary in response to simulated icy, wet, or cold track surface conditions, as well as tire wear, fuel consumption, or engine power and reliability. The simulated racing conditions can be effected as pre-programmed options built into the circuitry of the control/transmitter system or through a personal computer/software package connected to the transmitter.

Although the invention has been described hereinabove in connection with disclosed embodiments, it would be appreciated that many variations and modifications may be made without departing from the spirit and scope of the invention. A latitude of modification, change and substitution is intended in the foregoing disclosure and in some instances some features of the invention will be employed without a corresponding use of other features.

We claim:

1. A model vehicle for operation on a slotted track including a chassis, wheels, a drive motor for powering the wheels of said vehicle, a guide element movably connected to said chassis, and actuation means for effecting the lateral movement of said guide element for guiding and maneuvering said vehicle about the track, said guide element having a downwardly extending guide pin for engagement with a slot in the track, whereby the lateral movement of said guide element effects the lateral displacement of said model vehicle.

2. The model vehicle of claim 1 wherein said guide element includes an elongate arm having a pivot end and a distal end, said distal end including said slot engaging guide pin and said pivot end being pivotly mounted to said chassis.

3. The model vehicle of claim 2 wherein said guide arm actuation means comprises a motor.

4. The model vehicle of claim 3 wherein said guide arm actuation means is drivingly connected to said motor by gear means.

5. The model vehicle of claim 4 wherein said guide arm is biased against said gear means by a biasing means in torque limiting engagement therewith.

6. The model vehicle of claim 5 wherein said gear means includes at least one gear.

7. The model vehicle of claim 6 wherein the pivot end of said guide arm includes projecting clutch teeth that are in biased, interlocking engagement against projecting clutch teeth concentrically located on said gear wherein said biased, interlocking clutch teeth disengage upon application of a predetermined torque against said guide arm.

8. The model vehicle of claim 7 wherein said clutch teeth are biased towards each other by means of a spring.

9. The model vehicle of claim 7 including stop means to limit the lateral movement of said guide arm.

10. The model vehicle of claim 9 further comprising means to receive, decode, and carry out electronic instructions for actuating speed and direction control.

11. A model vehicle racing assembly including a raceway having a guide slot running longitudinally along or parallel to the centerline thereof and at least one model racing vehicle for operation on said raceway, said vehicle including a chassis, wheels, a drive motor for powering the wheels of said vehicle, a guide element movably connected to said chassis, and actuation means for effecting the lateral movement of said guide element for guiding and maneuvering said vehicle about the track, said guide element having a downwardly extending guide pin for engagement with a slot in the track, whereby the lateral movement of said guide element effects the lateral displacement of said model vehicle.

12. The racing assembly of claim 11 wherein said guide slot includes at least two busbars positioned parallel to and coextensive therewith.

13. The racing assembly of claim 12 wherein said model vehicle further comprises means to receive, decode, and carry out electronic instructions for actuating speed and direction control.

14. The racing assembly of claim 12 wherein one of said busbars is positioned on the bottom surface of said guide slot.

15. A model vehicle for operation on a slotted track including a chassis, wheels, a drive motor for powering said wheels, a guide element movably connected to the chassis, said guide element including a guide arm having an intergral downwardly depending guide pin positioned on the distal end thereof for engagement with a guide slot in said track, wherein the distal end of said guide arm extends beyond the side of said vehicle chassis, and a guide element actuation means to effect the movement of said guide element.

16. The model vehicle of claim 15 wherein said guide element includes a pivot end pivotly mounted to said chassis.

17. The model vehicle of claim 16 wherein said guide element actuation means is drivingly connected to said motor by gear means.

18. The model vehicle of claim 17 wherein said guide element is biased against said gear means by a biasing means in torque limiting engagement therewith.

19. The model vehicle of claim 18 wherein the pivot end of said guide element includes projecting clutch teeth that are in biased, interlocking engagement against projecting clutch teeth concentrically located on said gear means wherein said biased, interlocking clutch teeth disengage upon application of a predetermined torque against said guide element.

20. The model vehicle of claim 19 wherein said clutch teeth are biased towards each other by spring means.

* * * * *